US006431973B1

(12) United States Patent
Tsung

(10) Patent No.: US 6,431,973 B1
(45) Date of Patent: Aug. 13, 2002

(54) STRUCTURE OF TURBINE EXHAUSTER

(76) Inventor: Kao-Hsung Tsung, No. 17, Lane 51, Hnm Kuang Street, Taipei (TW)

( * ) Notice: Subject to any disclaimer, the term of this patent is extended or adjusted under 35 U.S.C. 154(b) by 0 days.

(21) Appl. No.: 09/934,712

(22) Filed: Aug. 23, 2001

(51) Int. Cl.[7] ..... F23L 17/02
(52) U.S. Cl. ..... 454/18
(58) Field of Search ..... 454/15, 17, 18, 454/366, 367

(56) References Cited

U.S. PATENT DOCUMENTS 3,267,833 A * 8/1966 Artis et al. ..... 384/282
3,311,433 A * 3/1967 Graham et al. ..... 384/610
3,392,659 A * 7/1968 Rousey ..... 454/18
3,590,720 A * 7/1971 Siegal ..... 384/617
4,115,032 A * 9/1978 Lange ..... 416/197 A
4,582,250 A * 4/1986 Kolt ..... 236/49.5
4,697,736 A * 10/1987 Kolt ..... 236/49.5
5,326,313 A * 7/1994 Miniat ..... 454/18
5,571,045 A * 11/1996 Tsung ..... 454/18

* cited by examiner

*Primary Examiner*—Harold Joyce
*Assistant Examiner*—Derek S. Boles
(74) *Attorney, Agent, or Firm*—Bacon & Thomas, PLLC

(57) ABSTRACT

An improved structure of a turbine exhauster. The exhauster includes a fan assembly, an operating assembly and a fixing assembly, wherein the connecting points on the components of the assemblies have mounting holes and the turbine exhauster is assembled directly by using pull pins or screws. The fixing assembly includes an upper, a lower portion and a fixing seat of a central seat. The upper portion and the lower portion of the central seats are formed respectively from a plurality of upper sheets and lower sheets to complete the cylindrical structure. The bottom edge of the upper portion and the top edge of the lower portion are both beveled. By rotating the upper portion, the fan assembly can be adjusted at a slope of a supporting surface to a horizontal state. A user can be easily assembled and all the components can be packaged in a compact case.

6 Claims, 8 Drawing Sheets

STRUCTURE OF TURBINE EXHAUSTER

BACKGROUND OF THE INVENTION

1. Field of the Invention

The present invention is related to an improved structure of a turbine exhauster which can be assembled directly by using pull pins or screws, thereby the turbine exhauster can be assembled by a user himself; and especially to an improved structure of a turbine exhauster of which all the components can be packaged in a case separately after finishing of manufacturing, thereby volume occupied by all the components of the entire turbine exhauster can be reduced in favor of warehousing and transportation of the turbine exhauster.

2. Description of the Prior Art

Generally, in effectively improving heat-sinking problem in a factory, the more effective and economic processing way used nowadays is to mount a turbine exhauster driven naturally without electricity on the roof of the factory, wherein, by the principle that hot air rises, hot air drives the blades of the turbine exhauster to rotate, and an air drawing action is induced to exhaust the hot air in the factory out from the roof of the factory. In this way, the heat-sinking problem of a factory can be solved, and quality of the indoor air can be improved; thereby, a cozy working environment can be provided.

However generally, a turbine exhauster is structurally comprised of a spherical turbine-like fan assembly, an operating assembly and a fixing assembly. The structure of the whole turbine exhauster occupies a quite large volume after these assemblies are assembled, and the components in all the assemblies are assembled directly in the factory; these not only increases the cost of assembling of the whole turbine exhauster, but also by virtue that the turbine exhauster is transported directly by a dealer to the working site of a user, difficulty as well as cost of transportation are increased and make waste of cost.

To solve the above stated defects of too large volume of the turbine exhauster and increasing of difficulty as well as cost of transportation, one after another, manufacturers tend to package after detaching the components of a turbine exhauster to reduce the volume of the entire turbine exhauster in favor of warehousing and transportation of the turbine exhauster. The fan assembly and the operating assembly among the components of the turbine exhauster are relatively smaller, perhaps they can be detached; however, the problem of occupation of large volume of other components, such as a cylindrical central seat with a larger diameter, still can not be solved if no delicate design is given, and this is the largest trouble resided in the art.

SUMMARY OF THE INVENTION

In view of this, the improved structure of a turbine exhauster of the present invention includes a fixing assembly comprising an upper portion and a lower portion of a central seat; wherein, the upper portion and the lower portion of the central seat are in the shapes of cylinders respectively formed by a plurality of arciform upper sheets and lower sheets, and can have the upper and lower sheets of the upper and the lower portions stacked before assembling of the turbine exhauster in order to reduce the volume of the entire turbine exhauster in favor of warehousing and transportation of the turbine exhauster. And this is the primary object of the present invention.

Another object of the present invention is to provide the improved structure of a turbine exhauster which includes an operating assembly comprising an upper bearing, a mandrel, a positioning sleeve, a lower annular seat and a plurality of lower supporting feet, and to provide mounting holes at the connecting points for a fan assembly, the fixing assembly and the operating assembly. During assembling, pull pins or screws can be directly used for connecting; this is convenient for a user to assemble by himself, and thereby: to reduce the cost of assembling of the whole turbine exhauster.

A further object of the present invention is to provide the improved structure of a turbine exhauster, wherein, the bottom edge of the upper portion and the top edge of the lower portion of the central seat are provided respectively with flanges slip one over the other, so that the upper portion and the lower portion of the central seat can be connected with each other. And the bottom edge of the upper portion and the top edge of the lower portion of the central seat are both bevel, by rotating the upper portion of the central seat, the fan assembly can be adjusted in pursuance of the slope of any roof to a horizontal state.

Another object is to provide the improved structure of a turbine exhauster of the present invention, wherein, a pair of the lower sheets have at a lower area of the junction thereof a clamping set with two angle bars respectively provided on the two lower sheets, and a screw is screwed tight for fixing. This allows a user to loosen the clamping set timely to adjust the orientation of the upper portion of the central seat.

The present invention will be apparent in its particular structural characteristics and functions after reading the detailed description of the preferred embodiment thereof in reference to the accompanying drawings.

DETAILED DESCRIPTION OF THE PREFERRED EMBODIMENT

Figure 1:
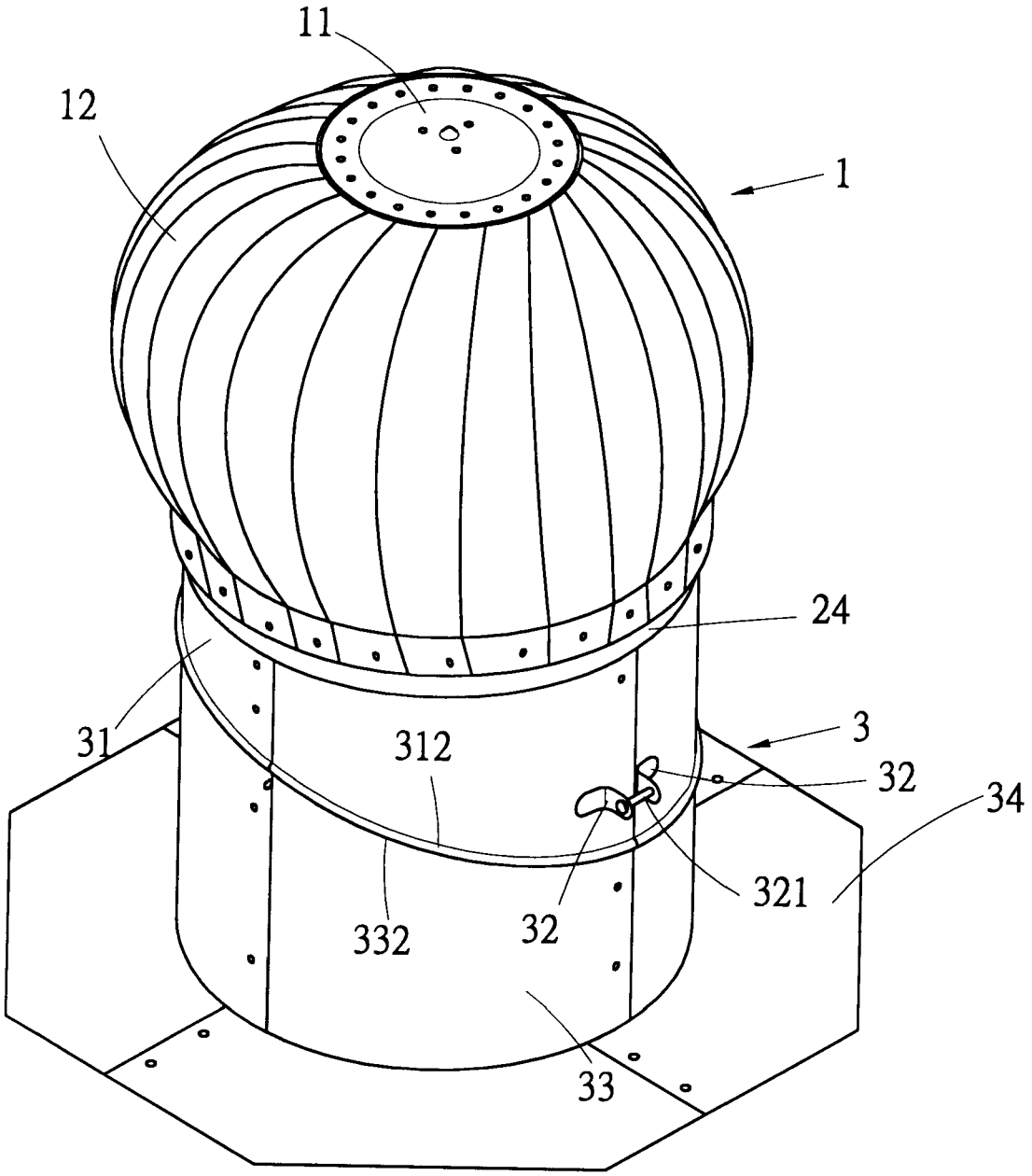
FIG. 1 is a perspective view of the present invention showing the appearance thereof.
Figure 2:
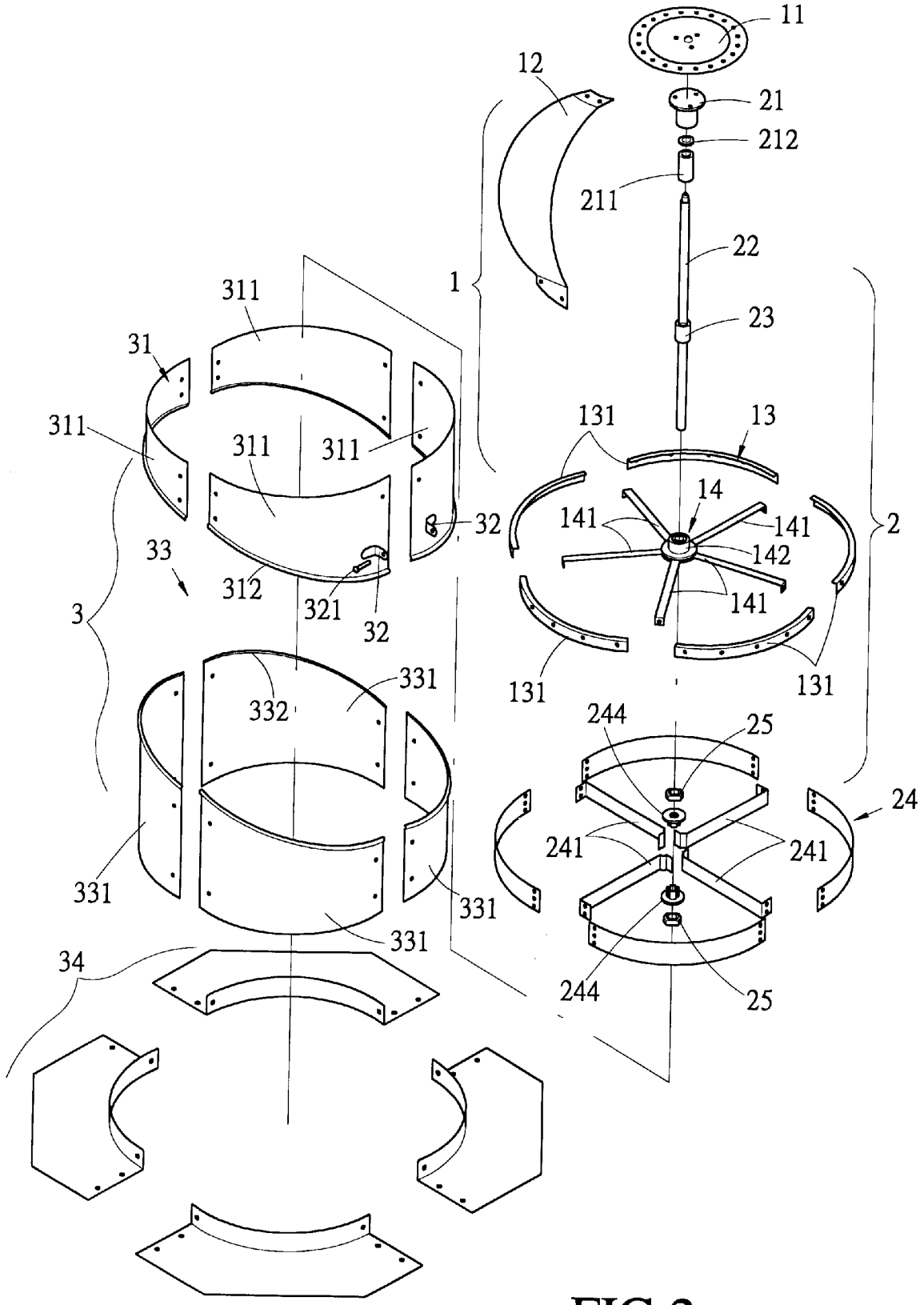
FIG. 2 is an analytical perspective of the present invention.

Referring firstly to FIGS. 1 and 2, the improved structure of a turbine exhauster of the present invention is structurally comprised of a fan assembly 1, an operating assembly 2 and a fixing assembly 3, wherein:

The fan assembly 1 has a top lid 11 as a main body thereof, and is provided with multiple arciform blades 12 mutually connected and fixed on the periphery of the top lid 11. The lower ends of the arciform blades 12 are fixed on the periphery of an external annular seat 13 formed by connecting of a plurality of external annular strips 131. Thereby, a turbine-like fan is obtained. The external annular seat 13 is provided centrally thereof with an upper support 14 having a plurality of struts 141 radially arranged around the center of the turbine exhauster and having a lower bearing 142 central y. There are assembling holes provided at the areas for connecting the top lid 11 and the arciform blades 12, for connecting the arciformb lades 12 and the external annular seat 13 as well as for connecting the external annular seat 13 and the upper support 14. Thereby, during assembling, they can be assembled directly by using pull pins or screws.

Figure 3:
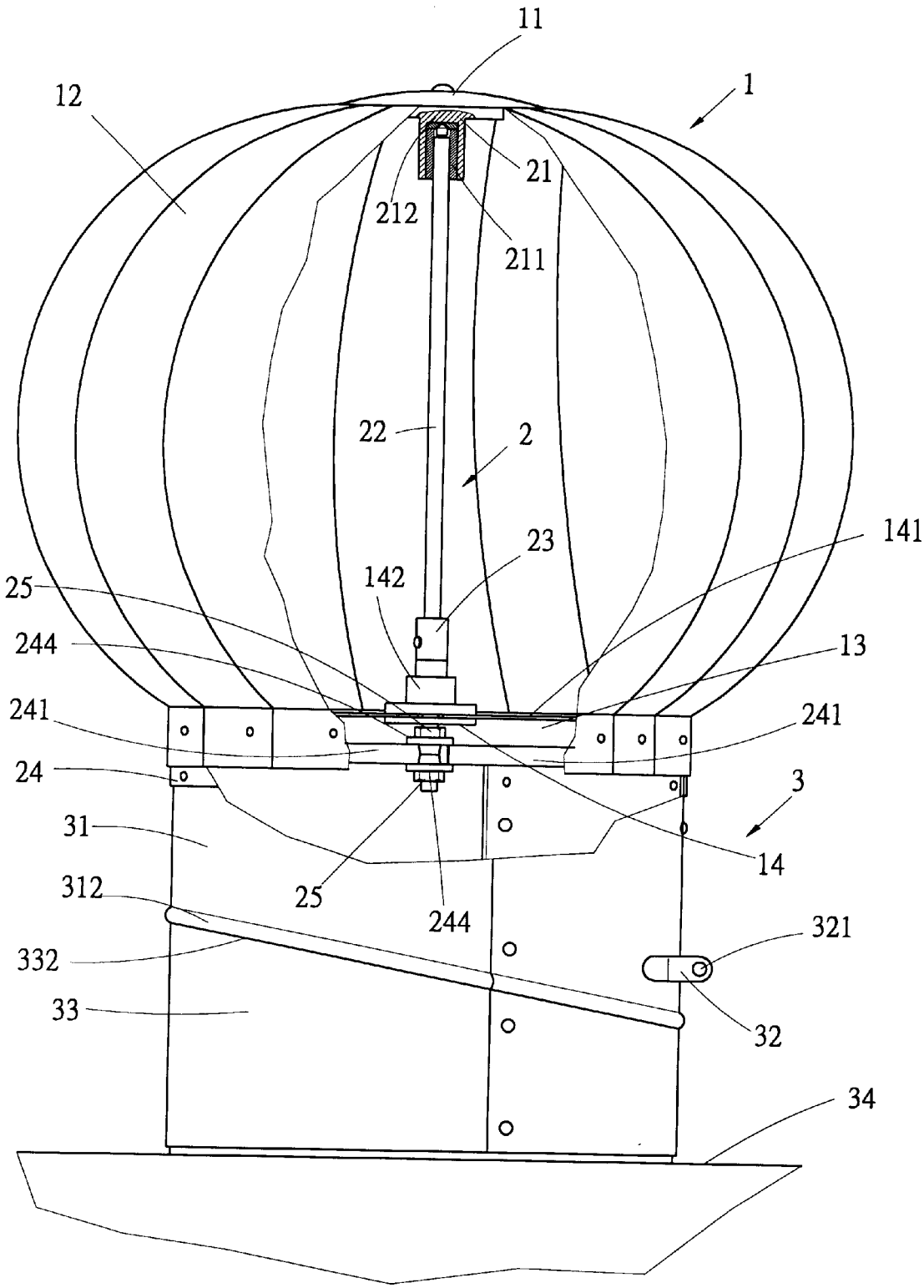
FIG. 3 is a sectional view showing the structure of the present invention.
Figure 10:
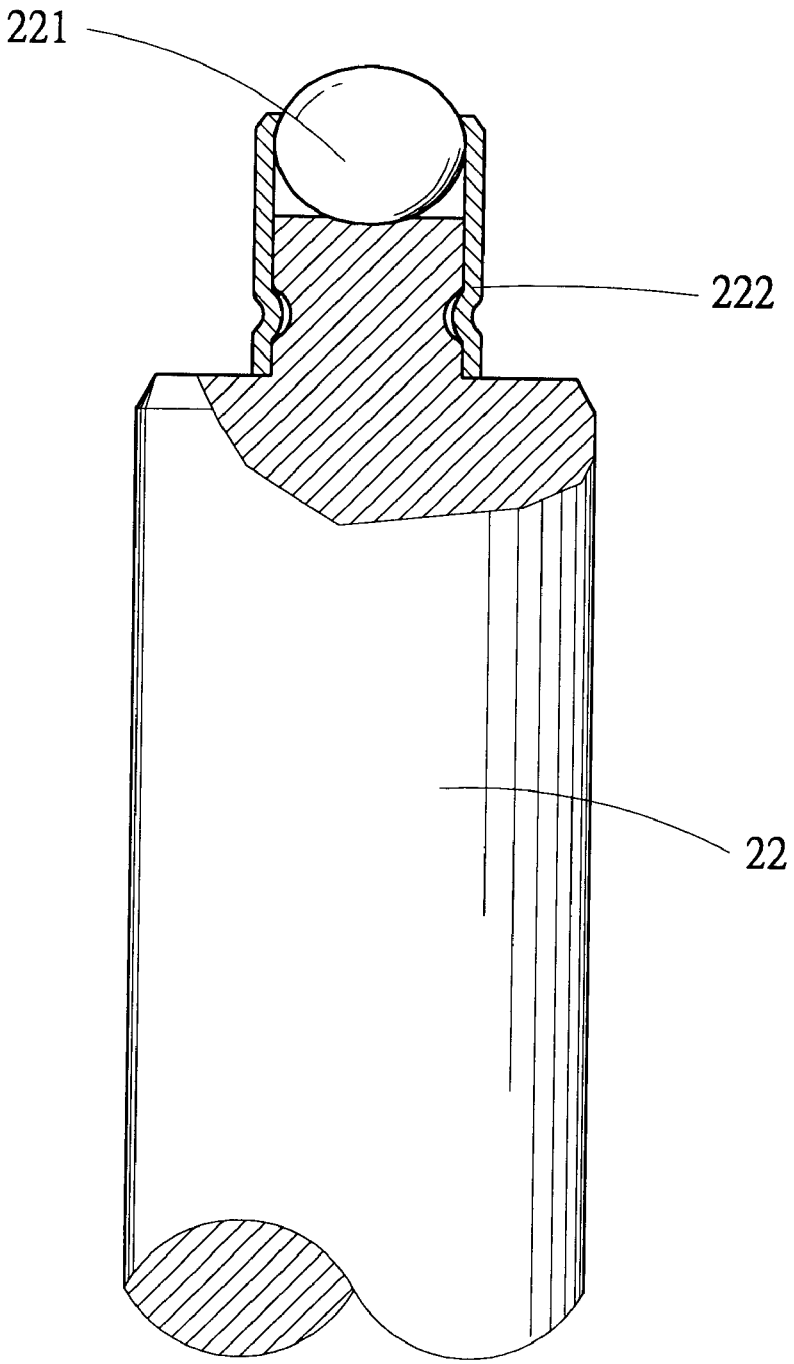
FIG. 10 is a sectional view showing assembling of the central axle with an upper bearing of the present invention.

The operating assembly 2 is provided with an upper bearing 21 fixed beneath the top lid 11. The upper bearing 21 and the top lid 11 are locked together with screws in order that the upper bearing 21 can be changed afterwards. A mandrel 22 is extended through the lower bearing 142 upwardly to slip the top end thereof into the upper bearing 21, and a fixing sleeve 23 is fixed on the mandrel 22 for positioning the latter. As shown in FIGS. 3 and 10, the mandrel 22 is provided on the top thereof with a steel bead 221 which is positioned on the top of the mandrel 22 by a holding sleeve 222 to abut against the upper bearing 21. The upper bearing 21 has a liner 211 to stabilize the mandrel 22, and also has an abrasion-durable rotation seat 212 at the area that the top of the mandrel 22 slips therein. By pivotal supporting of the top of the mandrel 22, the fan assembly 1 can have a reduced abrasion resistance.

Figure 4:
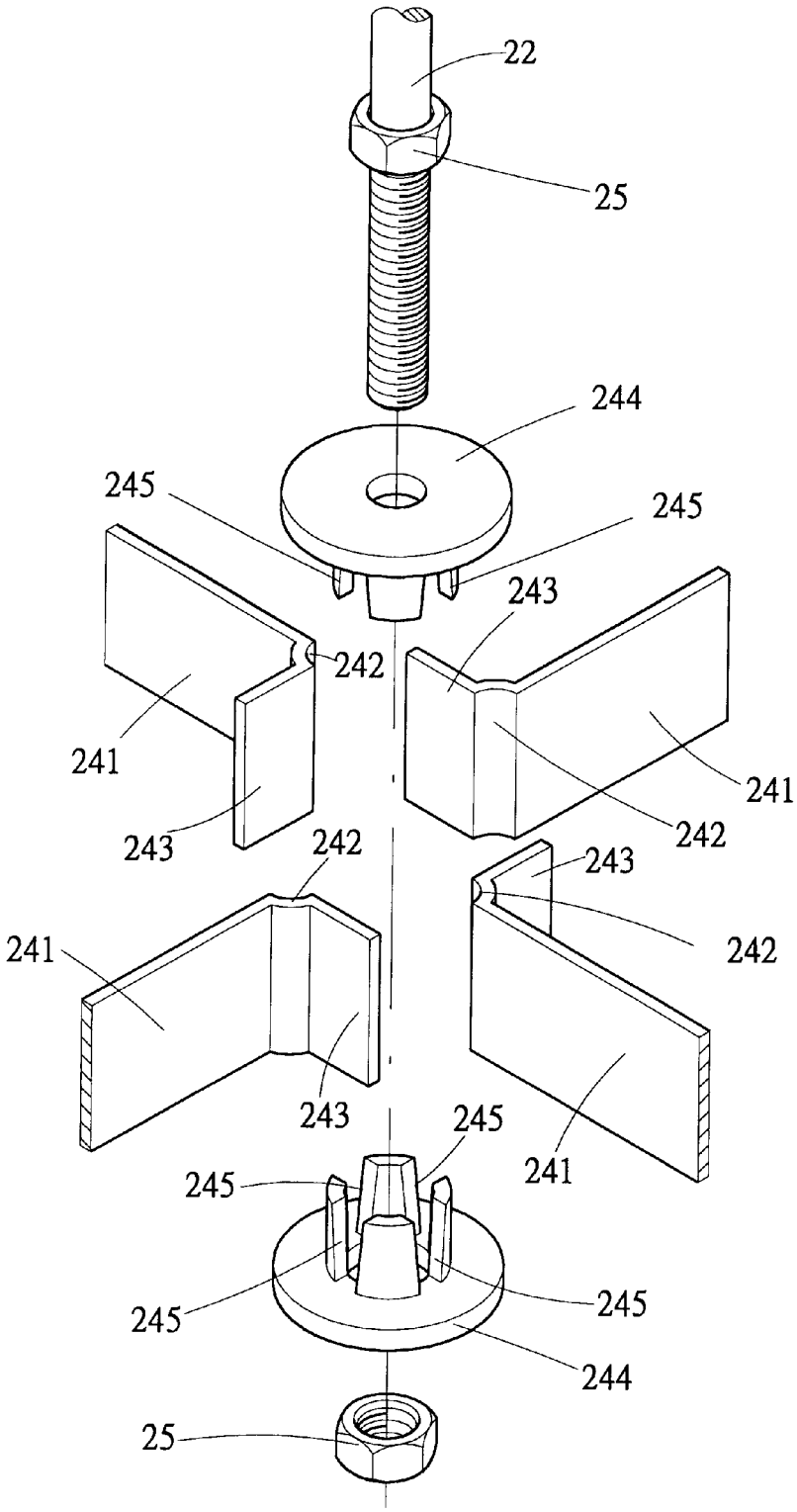
FIG. 4 is an analytical perspective view showing the central axle and a plurality of lower supporting feet of the present invention connectable mutually.
Figure 5:
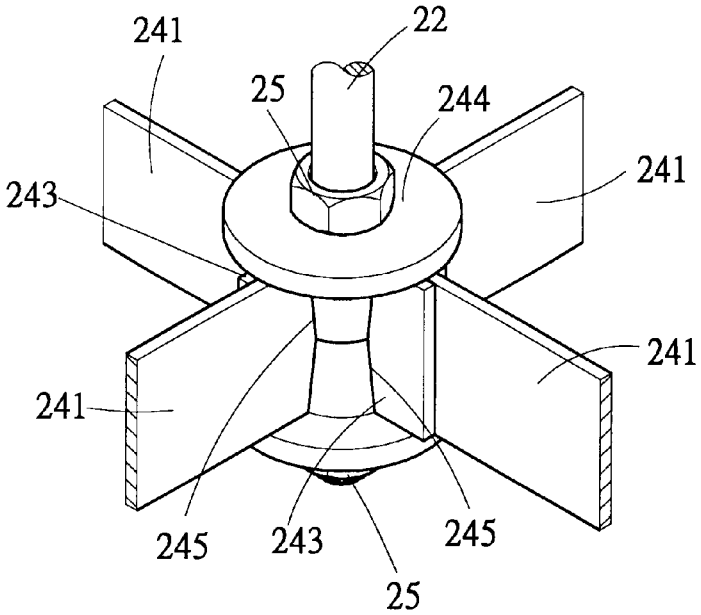
FIG. 5 is a perspective view showing the central axle and the lower supporting feet of the present invention after connecting.

Referring simultaneously to FIGS. 2 and 4, the mandrel 22 is provided on the lower end thereof with a lower annular seat 24 of which the inner side is fixed thereon with a plurality of lower supporting feet 241 radially arranged around the center of the turbine exhauster. Wherein, pairs of the lower supporting feet 241 are respectively oppositely disposed in order to fixedly clamp the mandrel 22 therebetween, each pair of the lower supporting feet 241 clamping the mandrel 22 therebetween have on the inner ends thereof arciform recesses 242, and have on the inner ends thereof lapping sections 243 to lap with neighboring lower supporting feet 241. When all the lower supporting feet 241 are lap connected with one another, they are clamped in position by using two clamping members 244 provided on the top and the bottom of the lower supporting feet 241. The clamping members 244 are provided with a plurality of clamping mouths 245 or clamping the lower supporting feet 241 and the lapping sections 243. The openings of the clamping mouths 245 are wider than the root portions thereof, so that when the two clamping members 244 get close to each other as shown in FIG. 5, a nut 25 can be used to clamp them tight, by the clamping action of the clamping mouths 245 on the lower supporting feet 241, the lower supporting feet 241 clamp tight the mandrel 22 in order that the lower supporting feet 241 are arranged on a plane. As shown in FIG. 2, the way of connecting of the lower supporting feet 241 with a plurality of external annular strips of the lower annular seat 24 is just the same as that of the external annular seat 13 with the external annular strips 131, thereby, the lower annular seat 24 is connected with the mandrel 22.

And the fixing assembly 3 is a cylindrical structure comprised of an upper portion 31 of a central seat and the lower portion 33 of the central seat slipping one over the other, as shown simultaneously in FIGS. 2 and. The upper portion 31 and the lower portion 33 of the central seat are formed respectively from a plurality of upper sheets 311 and a plurality of lower sheets 331 lapping with one another to complete the cylindrical structure. The combination of the fan assembly 1 and the operating assembly 2 is mounted on the top of the upper portion 31 of the central seat. A fixing seat 34 is provided on the bottom end of the lower portion 33 of the central s at in favor of assembling of the turbine exhauster on a roof. The fixing seat 34 has an annular central collar formed by lapping of a plurality of arciform strips and able to be slipped in the lower portion 33 of the central seat, these may reduce the volume of all the components.

Figure 6:
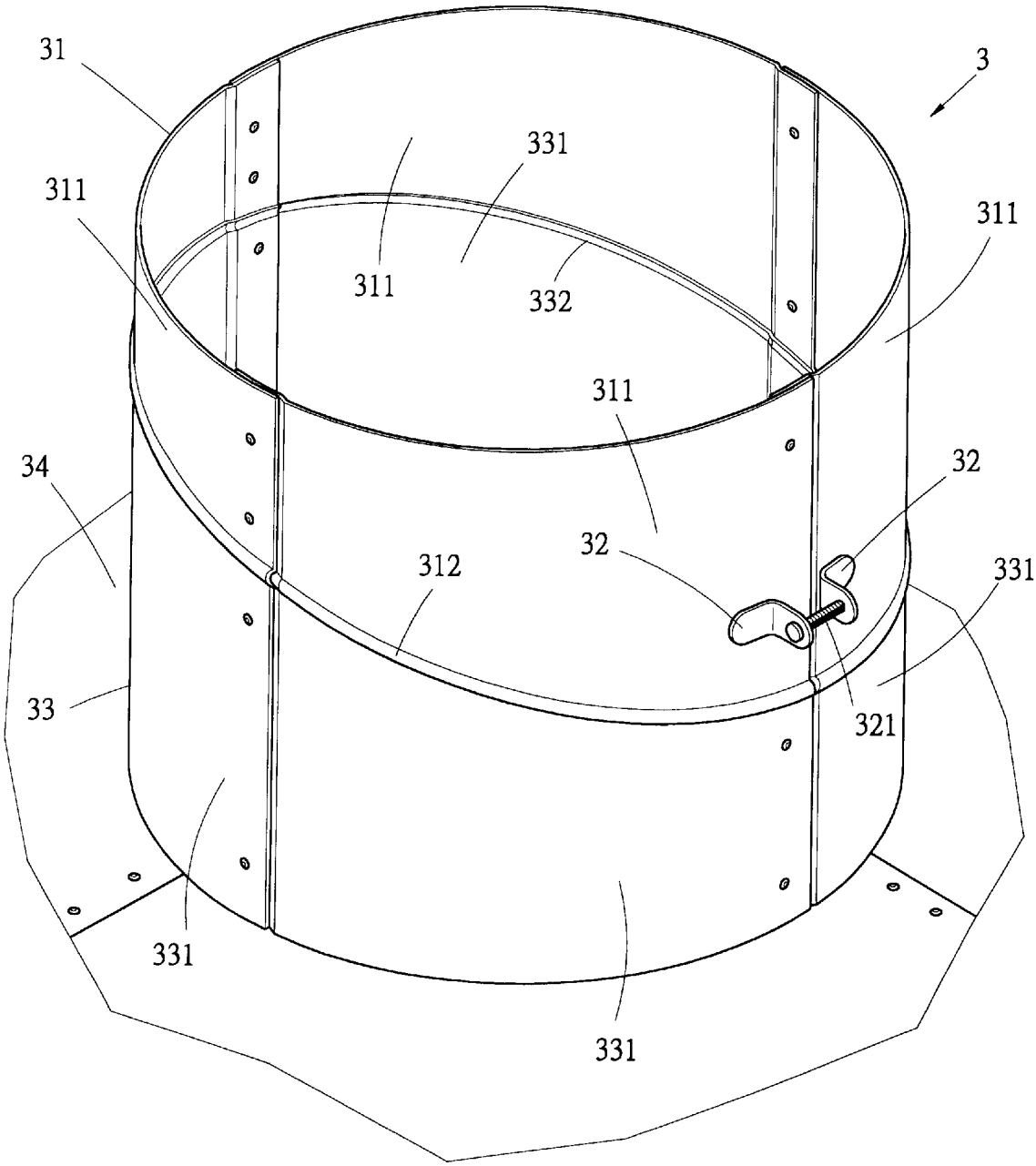
FIG. 6 is a perspective view showing a fixing assembly of the present invention.
Figure 8:
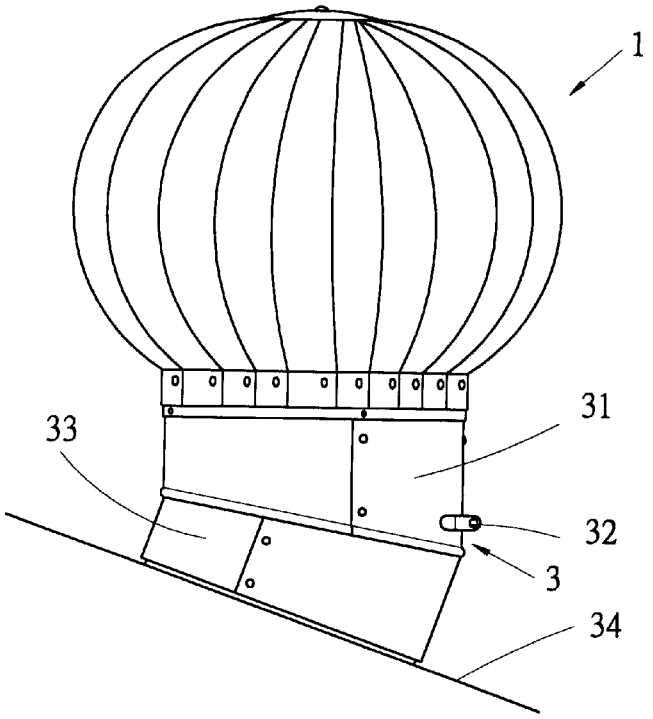
FIGS. 8 and 9 are schematic views showing the turbine exhauster of the present invention is assembled in different connecting tilting angles adjusted in pursuance of the slope of different roofs to a horizontal state.
Figure 9:
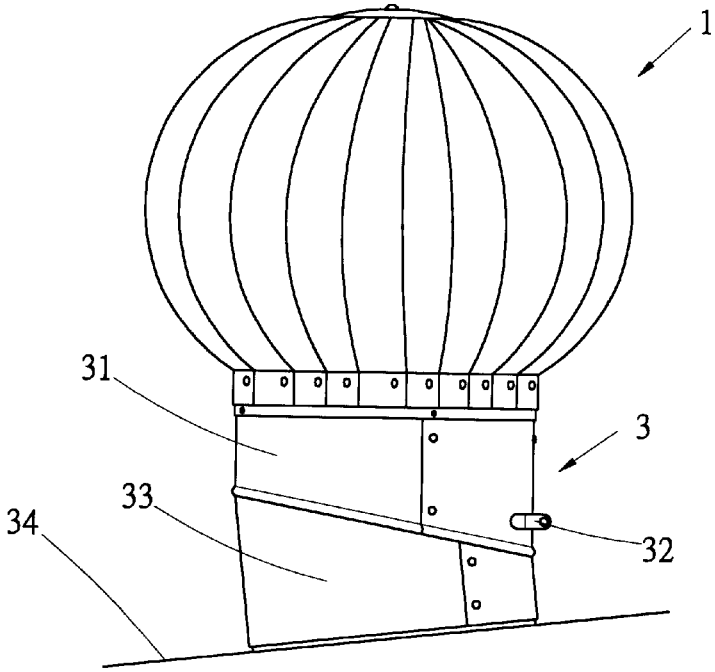

As shown simultaneously in FIGS. 3 and 6, the bottom edge of the upper portion 31 of the central seat and the top edge of the lower portion 33 of the central seat are provided respectively with flanges 312 and 332 able to slip one over the other, so that the upper portion 31 of the central seat and the lower portion 33 of the central seat can be connected with each other. A pair of the upper sheets 311 have at a lower area of the junction thereof a clamping set with two angle bars 32 respectively provided on the two upper sheets 311, and a screw 321 is screwed tight for fixing. This allows a user to loosen the angle bars 32 of the clamping set timely to adjust the orientation of the upper portion 31 of the central seat. Particularly, the bottom edge of the upper portion 31 and the top edge of the lower portion 33 of the central seat are both bevel as are depicted in FIGS. 8 and 9. In practical assembling of the turbine exhauster, a roof may not be totally identical in its slope, while the fixing seat 34 of the fixing assembly 3 shall be mounted snugly on the roof. Therefore, when in assembling, it is necessary to take advantage of the feature that the bottom edge of the upper portion 31 and the top edge of the lower portion 33 of the central seat are bevel to rotate the upper portion 31 of the central seat in pursuance of the slope of the roof to adjust the fan assembly 1 to a horizontal state.

Figure 7:
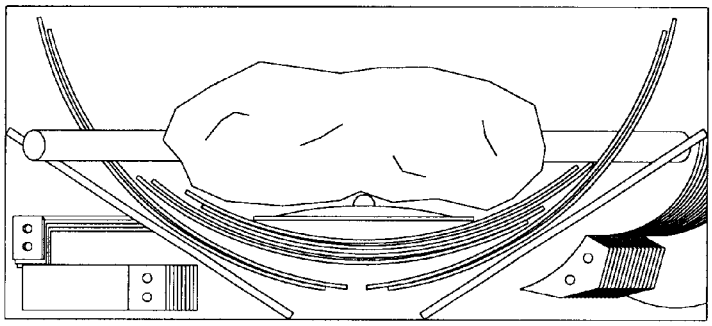
FIG. 7 is a schematic view showing packaging of all the components of the present invention in a case.

By the fact that the connecting points on the components of the fan assembly, the operating assembly and the fixing assembly are provided with mounting holes in advance; the turbine exhauster can be assembled directly by using pull pins or screws, thereby the turbine exhauster can be assembled by a user himself; and all the components can be packaged in a case separately after finishing of manufacturing such as that shown in FIG. 7. Thereby, volume occupied by all the components of the entire turbine exhauster can be reduced in favor of warehousing and transportation of the turbine exhauster. And this largely reduces the cost of warehousing, clearing customs and effectively save the cost of transportation.

The improved structure of a turbine exhauster of the present invention has the operating assembly thereof designed to comprise an upper bearing, a mandrel, a fixing sleeve, a lower annular seat and lower supporting feet; and especially has the fixing assembly thereof designed to comprise the upper portion and the lower portion of the central seat as well as the fixing seat; and more the connecting points on the components of the fan assembly, the operating assembly and the fixing assembly are provided with mounting holes in advance, the turbine exhauster can be assembled directly by using pull pins or screws, thereby the turbine exhauster can be assembled by a user himself; and all the components can be packaged in a case separately after finishing of manufacturing, thereby, volume occupied by all the components of the entire turbine exhauster can be reduced in favor of warehousing and transportation of the turbine exhauster. Therefore, an improved embodiment of the structure of turbine exhauster is obtained The present invention has been started as above, what I claim as new and desire to be secured by Letters Patent of the United States are:

1. A structure of a turbine exhauster, said turbine exhausted structurally comprises:

a fan assembly;

an operating assembly and a fixing assembly;

said fan assembly comprises a turbine-like fan with multiple arciform blades, lower ends of said arciform blades are fixed on an external annular seat;

said external annular seat comprises an upper support adapted to be rotated by exhaust air at a central location thereof;

said operating assembly comprises an upper bearing fixed beneath a top lid of said fan assembly;

a mandrel is extended upwardly through a lower bearing to slip a top end thereof into said upper bearing so that said mandrel extends through the fan assembly and supports said fan assembly for rotation;

said fixing assembly is a cylindrical structure comprising a cylinder upper portion and a cylindrical lower portion that are slipped one over the other, said upper portion and said lower portion of said central seat are formed respectively from a plurality of upper sheets and a plurality of lower sheets that lap with one another to complete said cylindrical structure, the upper and lower portions are cylindrical shells having sloped end surfaces that are overlapped to form the cylindrical structure of the fixing assembly, the upper and lower portions are independently rotatable such that the mandrel can be positioned substantially vertically even when the turbine exhauster is placed on a roof line that is inclined from the horizontal;

the combination of said fan assembly and said operating assembly is mounted on the top of said upper portion of said central seat, a fixing seat is provided on the bottom end of said lower portion of said central seat in favor of assembling of said turbine exhauster on a roof, said fixing seat has an annular central collar being formed by lapping of a plurality of arciform strips; and the connecting points on the components of said fan assembly, said operating assembly and said fixing assembly are provided with mounting holes, said turbine exhauster is adapted to be assembled by securing pull pins or screws into the mounting holes.

2. The structure of a turbine exhauster as in claim 1, wherein, said fan assembly further comprises a top lid, the top lid is provided with multiple arciform blades mutually connected and fixed on a periphery of said top lid, the lower ends of said arciform blades are fixed on a periphery of said external annular seat formed by connecting a plurality of external annular strips, to form a turbine-like fan; said external annular seat is provided centrally thereof with an upper support having a plurality of struts radially arranged around a center of said turbine exhauster and a lower bearing located centrally thereof; said upper bearing of said operating assembly is fixed beneath said top lid, a fixing sleeve is[]fixed on a stem of said mandrel, said mandrel is provided on a lower end thereof with a lower annular seat, an inner side of which is fixed with a plurality of lower supporting feet radially arranged around the center of said turbine exhauster, said lower supporting feet fixedly clamp said mandrel, thereby said lower annular seat is connected with said mandrel.

3. The structure of a turbine exhauster as in claim 1, wherein, a bottom edge of said upper portion and the top edge of said lower portion of said central seat are provided respectively with flanges that slip one over the other, so that said upper portion and said lower portion of said central seat are connected with each other, and said bottom edge of said upper portion and said top edge of said lower portion of said central seat are both bevel, such that by rotating said upper portion of said central seat, said fan assembly is adjusted in pursuance of slope of a surface to a horizontal state for assembling on said surface.

4. The structure of a turbine exhauster as in claim 3, wherein, a pair of said upper sheets have at a lower area of the junction thereof a clamping set with two angle bars respectively provided on said two upper sheets, and a screw is screwed tight for fixing, thereby permitting a user to loosen and lock said angle bars of said clamping set after adjusting orientation of said upper portion of said central seat.

5. The structure of a turbine exhauster as in claim 2, wherein, pairs of said lower supporting feat are opposingly disposed to fixedly clamp said mandrel therebetween, each mutually confronting pair of said lower supporting feet have on inner ends thereof arciform recesses adapted for clamping said mandrel therebetween and lapping sections on inner ends thereof for lapping with neighboring ones of said lower supporting feet, when all said lower supporting feet are lap connected with one another, they are clamped in position by using two clamping members provided on top and bottom of said lower supporting feet; said clamping members are provided with a plurality of clamping mouths for clamping said lower supporting feet and said lapping sections, the openings of said clamping mouths are adapted such that when two clamping members are positioned closely to each other, a nut is clamped to a threaded bottom of the mandrel, and by the clamping action of said clamping mouths on said lower supporting feet, said lower supporting feet clamp tightly said mandrel so that said lower supporting feet are arranged on a plane.

6. The improved structure of a turbine exhauster as in claim 1, wherein, said mandrel is provided on a top thereof with a steel bead which is positioned on a top of said mandrel by a holding sleeve to abut against said upper bearing, said upper bearing has a liner adapted to stabilize said mandrel and an abrasion-durable rotation seat at an area on which the top of said mandrel slips therein, by pivotally supporting the top of said mandrel, and said fan assembly has a reduced abrasion resistance.

* * * * *